US008215926B2

(12) United States Patent
Fields et al.

(10) Patent No.: US 8,215,926 B2
(45) Date of Patent: Jul. 10, 2012

(54) SCROLL COMPRESSOR COUNTERWEIGHT WITH COOLING FLOW DIRECTING SURFACE

(75) Inventors: Gene Fields, Arkadelphia, AR (US); Joe T. Hill, Arkadelphia, AR (US)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 303 days.

(21) Appl. No.: 12/633,820

(22) Filed: Dec. 9, 2009

(65) Prior Publication Data

US 2011/0135513 A1 Jun. 9, 2011

(51) Int. Cl.
*F04B 17/03* (2006.01)
*H02K 1/22* (2006.01)

(52) U.S. Cl. ..... 417/368; 310/261.1; 310/63

(58) Field of Classification Search ..... 417/368, 417/410.5; 310/261
See application file for complete search history.

(56) References Cited

U.S. PATENT DOCUMENTS 6,247,907 B1 * 6/2001 Williams et al. ..... 417/410.5
2009/0185931 A1 * 7/2009 Beagle et al. ..... 418/55.1

* cited by examiner

*Primary Examiner* — Charles Freay
(74) *Attorney, Agent, or Firm* — Carlson, Gaskey & Olds, PC

(57) ABSTRACT

A sealed compressor includes a housing for receiving a compressor pump unit and an electric motor. The electric motor drives a driveshaft. The driveshaft extends to drive an element within the compressor pump unit to compress a fluid. The motor includes a rotor spaced from a portion of the housing by a gap. The driveshaft drives a counterweight, which has a radially outermost portion extending radially outwardly beyond a radially innermost portion of the stator. The radially outermost portion of the counterweight has an angled face to drive fluid into the gap.

16 Claims, 2 Drawing Sheets

SCROLL COMPRESSOR COUNTERWEIGHT WITH COOLING FLOW DIRECTING SURFACE

BACKGROUND OF THE INVENTION

This application relates to a sealed compressor wherein a counterweight is configured to drive a suction fluid downwardly along a path to cool an electric motor associated with the compressor.

Sealed compressors are known, and typically include a housing defined by a center shell and opposed end caps. The center shell receives a compressor pump unit, which operates to compress a fluid and deliver the fluid from a suction port to a discharge port. An electric motor is received within the housing and operates to drive the compressor pump unit.

The housing typically defines sealed chambers including a discharge plenum and a suction plenum. The plenums are separated by structure within the housing. Often, fluid moving into the suction pressure plenum from the suction port is utilized to cool the electric motor before it is delivered to the compressor pump unit. Any number of techniques are utilized to provide this cooling, and to improve the flow of the suction pressure refrigerant over the motor. However, further improvements are still necessary.

SUMMARY OF THE INVENTION

A sealed compressor includes a housing for receiving a compressor pump unit and an electric motor. The electric motor drives a driveshaft, extending to drive an element within the compressor pump unit. The motor includes a stator spaced from a portion of the housing by a gap. The driveshaft drives a counterweight, which has a radially outermost portion extending radially outwardly beyond a radially innermost portion of the stator. The radially outermost portion of the counterweight has an angled face to drive fluid into the gap.

These and other features of the present invention can be best understood from the following specification and drawings, the following of which is a brief description.

DETAILED DESCRIPTION OF PREFERRED EMBODIMENTS

Figure 1:
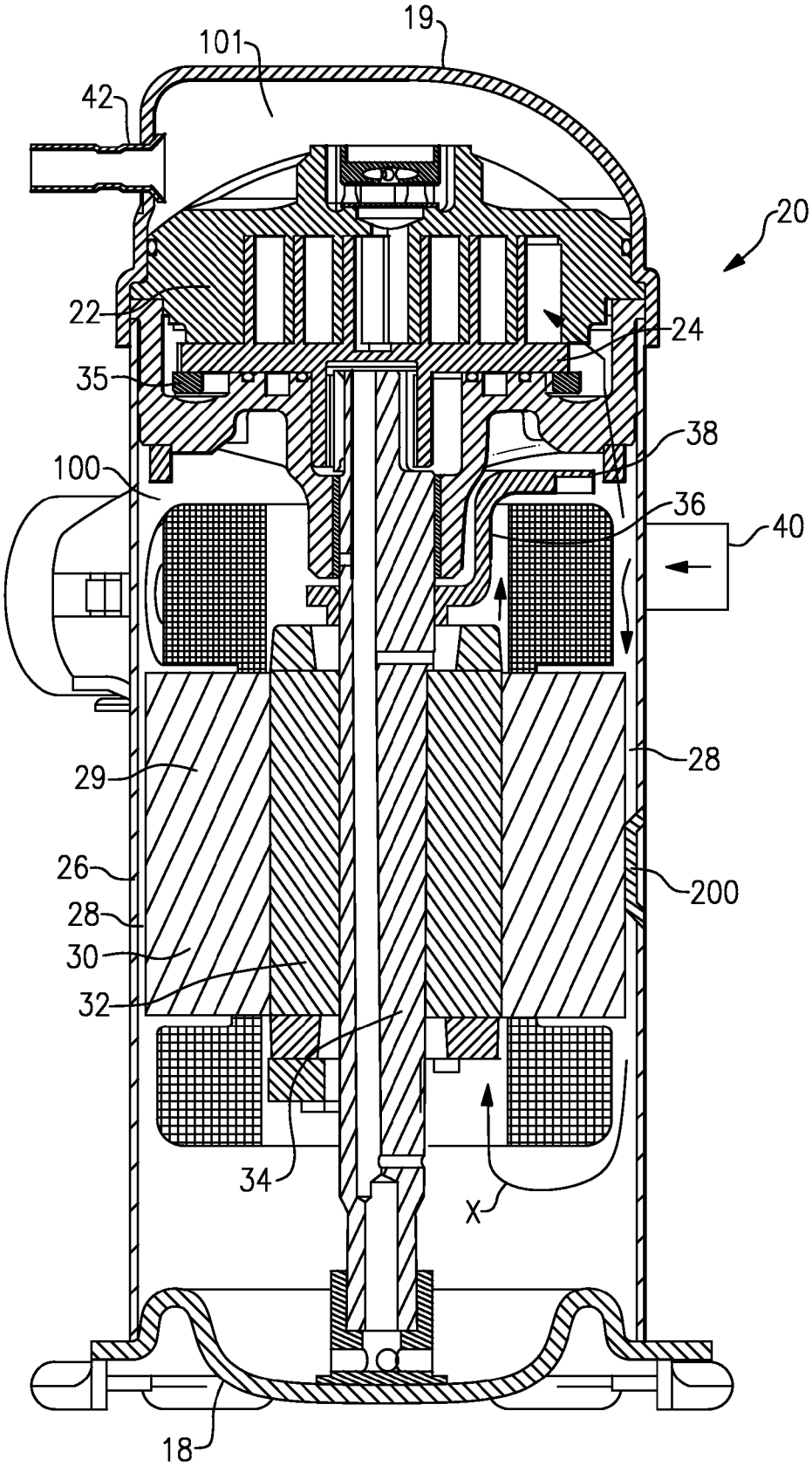
FIG. 1 is a cross-sectional view through an embodiment of this invention.

FIG. 1 shows a sealed compressor 20 having a housing defined by end caps 18 and 19 secured to a cylindrical shell 26. As known, cylindrical shell 26 extends along a center axis, and has an inner periphery. In combination, the end caps 18, 19 and center shell 26 define a sealed housing, and interact with a compressor pump unit to separate a discharge pressure plenum 101 from a suction pressure plenum 100.

The compressor pump unit illustrated in FIG. 1 is a scroll compressor unit having a non-orbiting scroll member 22, and an orbiting scroll member 24. The orbiting scroll member is driven to orbit relative to the non-orbiting scroll member 32 by a drive shaft 34, which drives the orbiting scroll member 24 through a non-rotation coupling 35, as known. As known, the scroll members 22 and 24 have generally spiral wraps which interfit to define compression chambers, and a refrigerant is entrapped, compressed, and driven into the discharge pressure plenum 101. From the plenum 101, refrigerant can pass outwardly through a discharge port 42 to a downstream use, such as a condenser in an air conditioning system.

The shaft 34 rotates about the center axis of the center shell 26, and is driven to rotate by a motor 29. Motor 29 includes a stator 30, which drives the rotor 32. The rotor 32 is fixed to drive the rotating shaft 34.

As shown, a suction port 40 delivers refrigerant to be compressed into the suction pressure plenum 101. Some of this refrigerant passes directly into the compression chambers, while some of it moves into a gap 28 between the stator 30 and the inner periphery of the center shell 26. This refrigerant moves downwardly through the gap 28, and along a path X back upwardly between an outer periphery of the rotor 32, and an inner periphery of the stator 30, to cool the motor. As shown, there may be a deformed portion 200 of the center shell 26 that is deformed radially inwardly to secure the stator 30 within the center shell 26. While a single small deformed portion 200 is illustrated, in fact, there should be a greater amount of deformed surface area. Aspects of how a center shell could be deformed to hold the motor stator are disclosed in co-pending patent application Ser. No. 12/633,831, filed on even date herewith and entitled "Deformed Shell For Holding Motor Stator In A Compressor Shell."

In an alternative method, the stator could be secured within the center shell by the spacer as disclosed in co-pending patent application Ser. No. 12/633,839, filed on even date herewith, and entitled "Sealed Compressor With Motor Standard Spacer Providing Bearing Mount."

On the other hand, any number of other methods to form the gap 28 would come within the scope of this invention.

The rotating shaft 34 carries a counterweight 36. Counterweight 36 is a relatively thin counterweight and has an outer peripheral portion 38 which extends radially outwardly over a radially inner portion of the stator 30. As can be seen, the outer portion 38 is positioned to be between the port 40 and the compressor pump unit. That is, in this embodiment, the outer portion 38 is vertically above port 40.

Figure 2A:
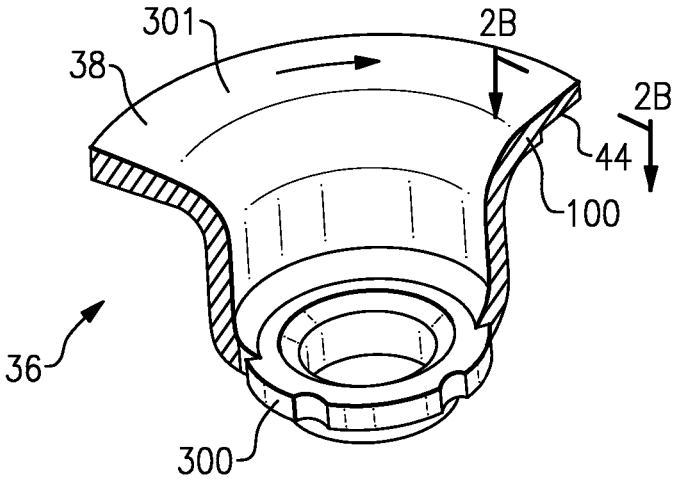
FIG. 2A shows an inventive counterweight.
Figure 2B:
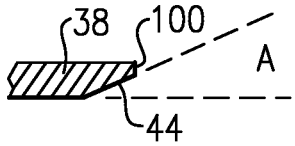
FIG. 2B shows a detail of the FIG. 2A counterweight.

As shown in FIGS. 2A and 2B, the outer portion 38 is configured to have an angled face 44 that will direct a portion of the fluid moving through the suction port 40 downwardly toward the gap 28. As detailed in FIG. 2B, this angled portion 44 may be angled along an angle that is between 20 and 45°. The angle mentioned is measured from a plane perpendicular to a drive axis of the shaft, and is shown as A in FIG. 2B. When the scroll compressor is operating, the counterweight 36 is driven to rotate at high speed, and the angled face 44 forces fluid downwardly and toward the gap 28 such that it will move into the path X in sufficient quantities to cool the motor. As can be appreciated from the Figures, a circumferential edge 100 of the counterweight outer portion 38 would be considered a "leading edge" given the rotational direction shown in FIG. 2A. As shown in FIG. 2B, the angled face 204 extends along a circumferential direction, and from the edge 100 counter-clockwise as shown in FIG. 2A, or in a direction opposed to the rotation direction. In this way, the angle face 44 defines a "scoop" to force refrigerant downwardly.

As can be appreciated from FIG. 2A, counterweight 36 includes a cylindrical portion 300 which is secured on the driveshaft, and a portion 301 which extends only about a portion of the circumferential cylindrical portion 300, and which includes the radially outermost portion 38. This general shape of a counterweight is known, however, the known counterweights did not have the angled surface 44 to assist in driving the suction fluid toward the gap between the motor and the center shell.

Figure 3:
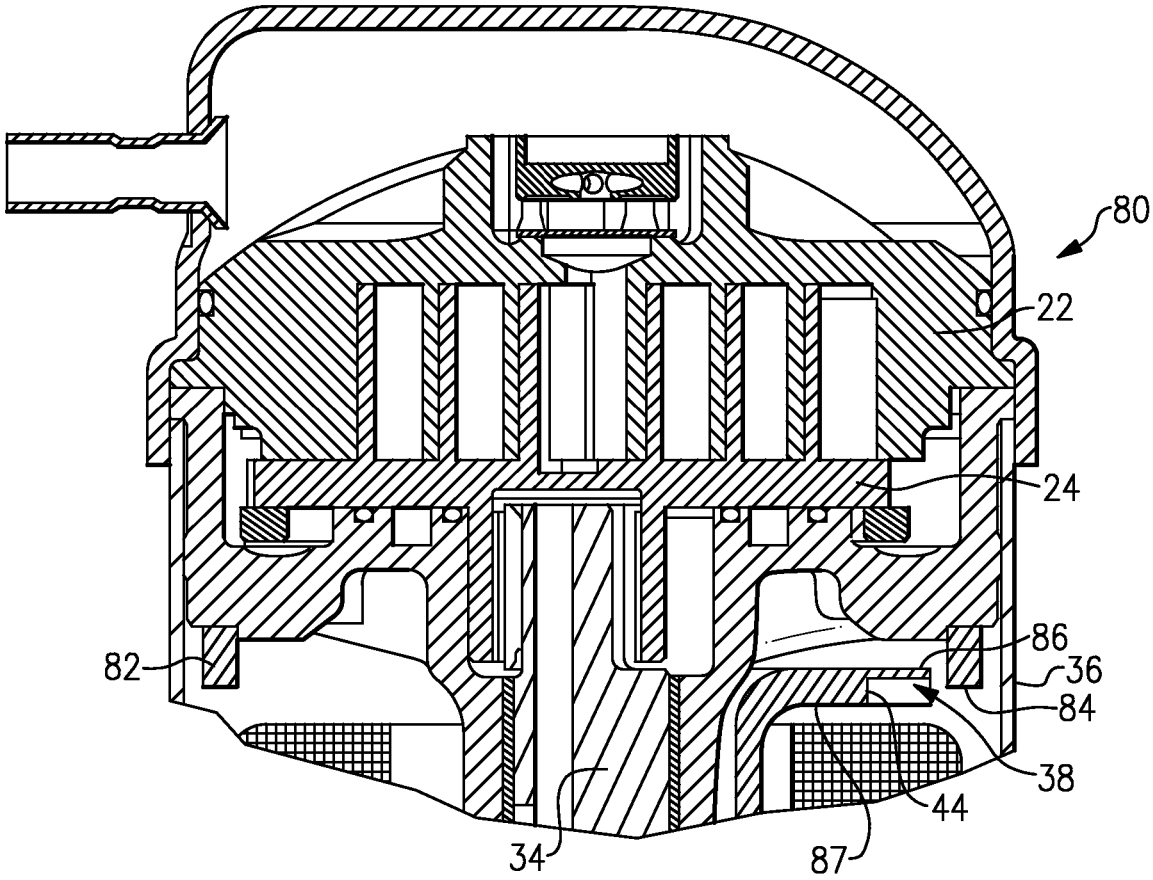
FIG. 3 is a cross-sectional view showing an additional feature.

As shown in FIG. 3, a further feature includes a baffle 82 extending downwardly to have a lowermost end 84 which is below an uppermost end 86 of the counterweight 36. The baffle 34 operates in conjunction with the outer portion 38 to ensure that the angled portion will drive fluid in sufficient quantities toward the gap 28. The end 84 of the baffle is between an axial extent of the counterweight, defined between an end 86 faced toward the compressor pump unit, and an end 87 spaced away from the compressor pump unit.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

a housing for receiving a compressor pump unit and an electric motor;

said electric motor driving a driveshaft, said driveshaft extending to drive an element within said compressor pump unit to compress a fluid;

said motor including a stator spaced from a portion of said housing by a gap, and said driveshaft driving a counterweight, said counterweight having a radially outermost portion which extends radially outwardly beyond a radially innermost portion of said stator, and said radially outermost portion of said counterweight having an angled face to drive fluid towards said gap, said angled face extending circumferentially from a leading edge of said counterweight, that will lead the counterweight as the counterweight rotates with the drive shaft; and said angled face being defined by an angle defined by a plane that extends perpendicular to a drive axis of said driveshaft, said angle being between 20 and 45° measured from said plane.

2. The sealed compressor as set forth in claim 1, wherein said compressor pump unit is a scroll compressor unit.

3. The sealed compressor as set forth in claim 1, wherein said radially outermost portion of said counterweight extends only about a portion of a circumference of said electric motor.

4. The sealed compressor as set forth in claim 1, wherein said housing includes a center shell, said center shell being secured to an outer peripheral surface of said stator.

5. The sealed compressor as set forth in claim 4, wherein said center shell is deformed to secure said center shell to said stator.

6. The sealed compressor as set forth in claim 1, wherein a suction tube extends through said center shell to deliver a suction fluid into a sealed space within said housing, and said suction fluid being the fluid driven by the radially outermost portion of said counterweight.

7. The sealed compressor as set forth in claim 6, wherein said radially outermost portion of said counterweight being between said suction port, and said compressor pump unit.

8. The sealed compressor as set forth in claim 7, wherein said driveshaft extends vertically along an axis, and said radially outermost portion of said counterweight being axially intermediate a vertically uppermost portion of said suction tube and a vertically lowermost portion of said compressor pump unit.

9. A sealed compressor comprising:

a housing for receiving a compressor pump unit and an electric motor;

said electric motor driving a driveshaft, said driveshaft extending to drive an element within said compressor pump unit to compress a fluid;

said motor including a stator spaced from a portion of said housing by a gap, and said driveshaft driving a counterweight, said counterweight having a radially outermost portion which extends radially outwardly beyond a radially innermost portion of said stator, and said radially outermost portion of said counterweight having an angled face to drive fluid towards said gap, said angled face extending circumferentially from a leading edge of said counterweight, that will lead the counterweight as the counterweight rotates with the drive shaft;

a baffle extending downwardly from said compressor pump unit, and assisting in driving fluid towards said gap.

10. The sealed compressor as set forth in claim 9, wherein said angled face is defined by an angle defined by a plane that extends perpendicular to a drive axis of said driveshaft, said angle being between 20 and 45° measured from said plane.

11. The sealed compressor as set forth in claim 9, wherein said baffle extends axially away from said compressor pump unit in a direction toward said electric motor such that an end of said baffle spaced away from said compressor pump unit extends beyond an axial end of said counterweight which is closest to said compressor pump unit.

12. The sealed compressor as set forth in claim 11, wherein said end of said baffle is within an axial extent of said radially outermost portion of said counterweight.

13. A sealed scroll compressor comprising:

a housing for receiving a scroll compressor pump unit and an electric motor;

said electric motor driving a driveshaft along a drive axis, said driveshaft extending to drive an orbiting scroll member in said compressor pump unit to compress a fluid;

said motor including a stator spaced from a portion of said housing by a gap, and said driveshaft driving a counterweight, said counterweight having a radially outermost portion which extends radially outwardly beyond a radially innermost portion of said stator, and said radially outermost portion of said counterweight having an angled face to drive a fluid towards said gap, said angled face extending circumferentially from a leading edge of said counterweight, that will lead the counterweight as the counterweight rotates with the drive shaft;

a baffle extending downwardly from said compressor pump unit, said baffle assisting in driving fluid toward said gap, said baffle extending axially away from said compressor pump unit in a direction toward said electric motor such that an end of said baffle spaced away from said compressor pump unit extends beyond an axially end of said counterweight which is closest to said compressor pump unit, and said end of said baffle being within an axial extent of said radially outermost portion of said counterweight; and a suction tube extending through said center shell to deliver a suction fluid into a sealed space within said housing, and said suction fluid being the fluid driven by the radially outermost portion of said counterweight, said radially outermost portion of said counterweight being between said suction port, and said compressor pump unit, and said driveshaft extending vertically along an axis, and said radially outermost portion of said counterweight being axially intermediate a vertically uppermost portion of said suction tube and a vertically lowermost portion of said compressor pump unit.

14. The sealed compressor as set forth in claim 13, wherein said angled face is defined by an angle defined by a plane that extends perpendicular to a drive axis of said driveshaft, said angle being between 20 and 45° measured from said plane.

15. The sealed compressor as set forth in claim 13, wherein said housing includes a center shell, said center shell being secured to an outer peripheral surface of said stator.

16. The sealed compressor as set forth in claim 15, wherein said center shell is deformed to secure said center shell to said stator.

* * * * *